US006590483B2

(12) United States Patent
Suzuki

(10) Patent No.: US 6,590,483 B2
(45) Date of Patent: Jul. 8, 2003

(54) ELECTROMAGNETIC SOLENOID ACTUATOR

(75) Inventor: Michinobu Suzuki, Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 10/163,569

(22) Filed: Jun. 7, 2002

(65) Prior Publication Data

US 2002/0186111 A1 Dec. 12, 2002

(30) Foreign Application Priority Data

Jun. 8, 2001 (JP) ..... 2001-174583

(51) Int. Cl.[7] ..... H01F 7/08; H01F 7/13
(52) U.S. Cl. ..... 335/274; 335/255; 335/273
(58) Field of Search ..... 335/255, 258, 335/264, 270, 273, 274

(56) References Cited

U.S. PATENT DOCUMENTS 5,422,617 A * 6/1995 Brown ..... 335/267
6,265,957 B1 7/2001 Baginski et al. ..... 335/266

FOREIGN PATENT DOCUMENTS

EP 1 085 532 A1 3/2001

* cited by examiner

*Primary Examiner*—Ramon M. Barrera
(74) *Attorney, Agent, or Firm*—Antonelli, Terry, Stout & Kraus, LLP

(57) ABSTRACT

An electromagnetic solenoid actuator comprising a cylindrical casing, an electromagnetic coil arranged in the casing, a fixed iron core arranged in the electromagnetic coil, a moving iron core arranged to come in contact with, and separate away from, the fixed iron core, and an operation rod mounted in the moving iron core, wherein provision is made of a position-limiting mechanism for limiting the operation rod to a plurality of operation positions according to a thrust produced by the operation rod in compliance with the amount of electric power fed to the electromagnetic coil.

3 Claims, 2 Drawing Sheets

ELECTROMAGNETIC SOLENOID ACTUATOR

FIELD OF THE INVENTION

The present invention relates to an electromagnetic solenoid actuator and, more specifically, to an electromagnetic solenoid actuator which can bring an operation rod to a plurality of operation positions.

DESCRIPTION OF THE RELATED ART

The electromagnetic solenoid actuator generally comprises a cylindrical casing, an electromagnetic coil arranged in the casing, a fixed iron core arranged in the electromagnetic coil, a moving iron core arranged to come in contact with, and separate away from, the fixed iron core, and an operation rod mounted in the moving iron core. In this electromagnetic solenoid actuator, the operation rod can be brought to two operation positions only due to its structure, i.e., to an operation position of when no electric current is supplied to the electromagnetic coil and to an operation position of when an electric current is supplied to the electromagnetic coil.

An electromagnetic solenoid which can bring an operation rod to three or more operation positions has been disclosed in Japanese Unexamined Utility Model Publication (Kokai) No. 193607/1983. The electromagnetic solenoid disclosed in this publication comprises a plurality of electromagnetic coils, a plurality of fixed iron cores and moving iron cores, wherein an operation rod mounted in the moving iron cores is brought to a plurality of positions by selectively supplying an electric current to the plurality of electromagnetic coils.

However, the electromagnetic solenoid disclosed in Japanese Unexamined Utility Model Publication (Kokai) No. 193607/1983 is constituted by a plurality of electromagnetic coils, a plurality of fixed iron cores and moving iron cores, i.e., constituted by using many parts, resulting in an increase in the size and in the cost.

SUMMARY OF THE INVENTION

It is an object of the present invention to provide a compact and inexpensive electromagnetic solenoid actuator which can bring an operation rod to a plurality of operation positions without using electromagnetic coils, fixed iron cores and moving iron cores in a plurality of numbers.

In order to accomplish the above-mentioned object according to the present invention, there is provided an electromagnetic solenoid actuator comprising a cylindrical casing, an electromagnetic coil arranged in the casing, a fixed iron core arranged in the electromagnetic coil, a moving iron core arranged to come in contact with, and separate away from, the fixed iron core, and an operation rod mounted on the moving iron core, wherein provision is made of a position-limiting mechanism for limiting the operation rod to a plurality of operation positions according to a thrust produced by the operation rod in compliance with the amount of electric power fed to the electromagnetic coil.

The position-limiting mechanism comprises at least one moving ring arranged on the operation rod or on an interlocking rod operated by the operation rod so as to slide, a first spring member arranged between the moving ring and the operation rod or the interlocking rod, and a second spring member arranged between the moving ring and the casing.

The position-limiting mechanism further comprises a first ring arranged on the operation rod or on the interlocking rod operated by the operation rod and is limited from moving toward the side of the moving iron core, a second ring and a third ring arranged on the operation rod or on the interlocking rod so as to slide on the side of the first ring opposite to the moving iron core, a first compression coil spring arranged between the first ring and the second ring, a second compression coil spring arranged between the second ring and the casing, a third compression coil spring arranged between the second ring and the third ring, and a fourth compression coil spring arranged between the third ring and the casing, a spring force of the second compression coil spring being greater than the spring force of the first compression coil spring, and the spring force of the fourth compression coil spring being greater than the spring force of the third compression coil spring.

DETAILED DESCRIPTION OF THE PREFERRED EMBODIMENTS

A preferred embodiment of the electromagnetic solenoid actuator constituted according to the invention will now be described in further detail with reference to the accompanying drawings.

Figure 1:
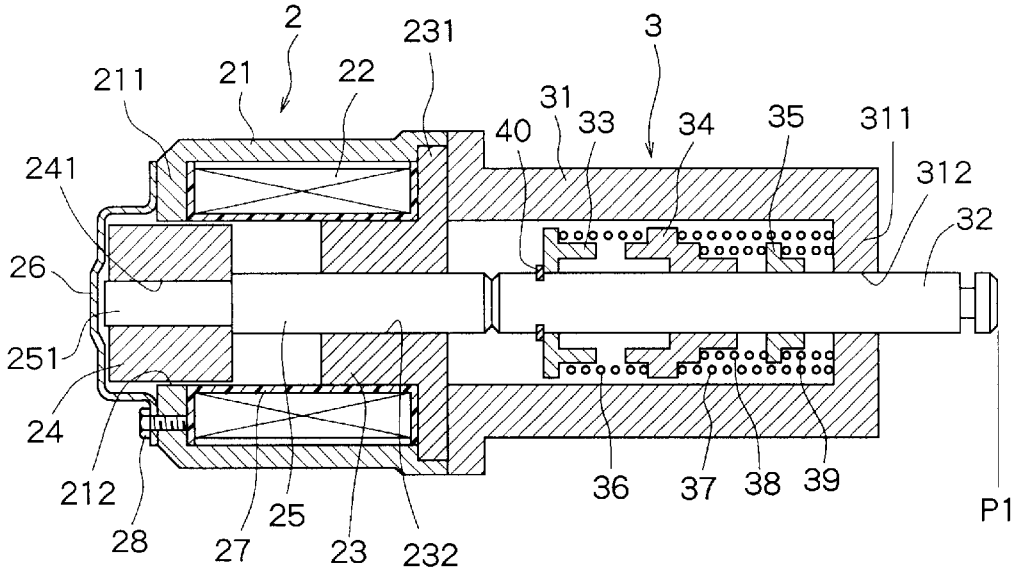
FIG. 1 is a sectional view illustrating an embodiment of an electromagnetic solenoid actuator constituted according to the present invention.

FIG. 1 is a sectional view illustrating an embodiment of the electromagnetic solenoid actuator constituted according to the present invention.

The electromagnetic solenoid actuator according to the illustrated embodiment includes an electromagnetic solenoid 2 and a position-limiting mechanism 3. The electromagnetic solenoid 2 includes a cylindrical casing 21, an electromagnetic coil 22 arranged in the casing 21, a fixed iron core 23 arranged in the electromagnetic coil 22, a moving iron core 24 arranged coaxially with the fixed iron core 23 being opposed to one end surface of the fixed iron core 23 (left end surface in FIG. 1), an operation rod 25 mounted in the moving iron core 24, and a cover 26 mounted on one end of the cylindrical casing 21 (left end in FIG. 1).

The cylindrical casing 21 has, at one end thereof (left end in FIG. 1), an end wall 211 having a hole 212 at the central portion thereof, and is opened at the other end thereof (right end in FIG. 1). The electromagnetic coil 22 is wound on an annular bobbin 27 made of a nonmagnetic material such as a synthetic resin or the like, and is disposed along the inner periphery of the casing 21. The fixed iron core 23 is formed of a magnetic material, has a flange portion 231 at the other end thereof (right end in FIG. 1), and is mounted on the other end of the casing 21 (right end in FIG. 1) via the flange portion 231. The moving iron core 24 is formed of a magnetic material, and is constituted to be brought into contact with, or moved away from, the fixed iron core 23 in the axial direction. The operation rod 25 is formed of a nonmagnetic material such as a stainless steel or the like, and has a small-diameter portion 251 formed at one end thereof (left end in FIG. 1). The thus constituted operation rod 25 is mounted in the moving iron core 24 with its small-diameter portion 251 being inserted in the hole 241 formed at the central portion of the moving iron core 24 and with its one end being caulked. The other end of the operation rod 25 is arranged to slide in the axial direction penetrating through a hole 232 formed at the central portion of the fixed iron core 23. The cover 26 is mounted on one end of the casing 21 by using screws 28 so as to cover an end of the casing 21 and an end portion of the moving iron core 24.

The position-limiting mechanism 3 will be described next.

The position-limiting mechanism 3 has a cylindrical casing 31 which is connected, at its one end, to the other end (right end in FIG. 1) of the casing 21 that constitutes the electromagnetic solenoid 2. An interlocking rod 32 is arranged in the casing 31 so as to slide in the axial direction coaxially with the operation rod 25 that constitutes the electromagnetic solenoid 2. The interlocking rod 32 comes, at its one end surface thereof (left end surface in FIG. 1), into contact with the other end surface of the operation rod 25, and has its other end (right end in FIG. 1) which is arranged so as to slide in the axial direction penetrating through a hole 312 formed in an end wall 311 at the right end of the casing 31 in FIG. 1. The interlocking rod 32 may be constituted integrally with the operation rod 25. The position-limiting mechanism 3 of the illustrated embodiment comprises a first moving ring 33, a second moving ring 34 and a third moving ring 35 which are arranged on the interlocking rod 32 so as to slide. The first moving ring 33 is limited by a snap ring 40 fitted to a left end portion of the operation rod 32 from moving toward the left in FIG. 1, i.e., from moving toward the moving iron core 24. The second moving ring 34 and the third moving ring 35 are arranged on the interlocking rod 32 so as to slide on the right side of the first moving ring 33 in FIG. 1, i.e., on the side opposite to the moving iron core 24. A first compression coil spring 36 is arranged between the first moving ring 33 and the second moving ring 34, and a second compression coil spring 37 is arranged between the second moving ring 34 and the end wall 311 of the casing 31 which is a fixing member. Further, a third compression coil spring 38 is arranged between the second moving ring 34 and the third moving ring 35, and a fourth compression coil spring 39 is arranged between the third moving ring 35 and the end wall 311 of the casing 31. The spring force of the second compression coil spring 37 is greater than the spring force of the first compression coil spring 36, and the spring force of the fourth compression coil spring 39 is greater than the spring force of the third compression coil spring 38. Therefore, the first moving ring 33 is thrusted leftward in FIG. 1 due to the spring forces of the first compression coil spring 36 and the second compression coil spring 37, and is brought into contact with the snap ring 40 at all times.

Though the position-limiting mechanism 3 of the illustrated embodiment is provided with three moving rings, the first moving ring 33 may be fixed to the interlocking rod 32. In this case, therefore, the first compression coil spring 36 is arranged between the second moving ring 34 and the interlocking rod 32. The illustrated embodiment has dealt with the position-limiting mechanism 3 which allowed the interlocking rod to be brought to the four operation positions. To have three operation positions, the moving ring that moves on the interlocking rod 32 may be the second moving ring 34 alone.

The electromagnetic solenoid actuator of the illustrated embodiment is constituted as described above. Now, described below is its function.

When no electric power is fed, i.e., in the case where no current is fed, to the electromagnetic coil 22 that constitutes the electromagnetic solenoid 2, the interlocking rod 32 is thrusted leftward in FIG. 1 due to spring forces of the first compression coil spring 36 and the second compression coil spring 37, whereby one end surface of the interlocking rod 32 comes into contact with the other end surface of the operation rod 25 that constitutes the electromagnetic solenoid 2 to thrust the operation rod 25 toward the left in the drawing. As a result, the interlocking rod 32, the operation rod 25 constituting the electromagnetic solenoid 2 and the moving iron core 24 are brought to a first operation position (P1) shown in FIG. 1.

Figure 2:
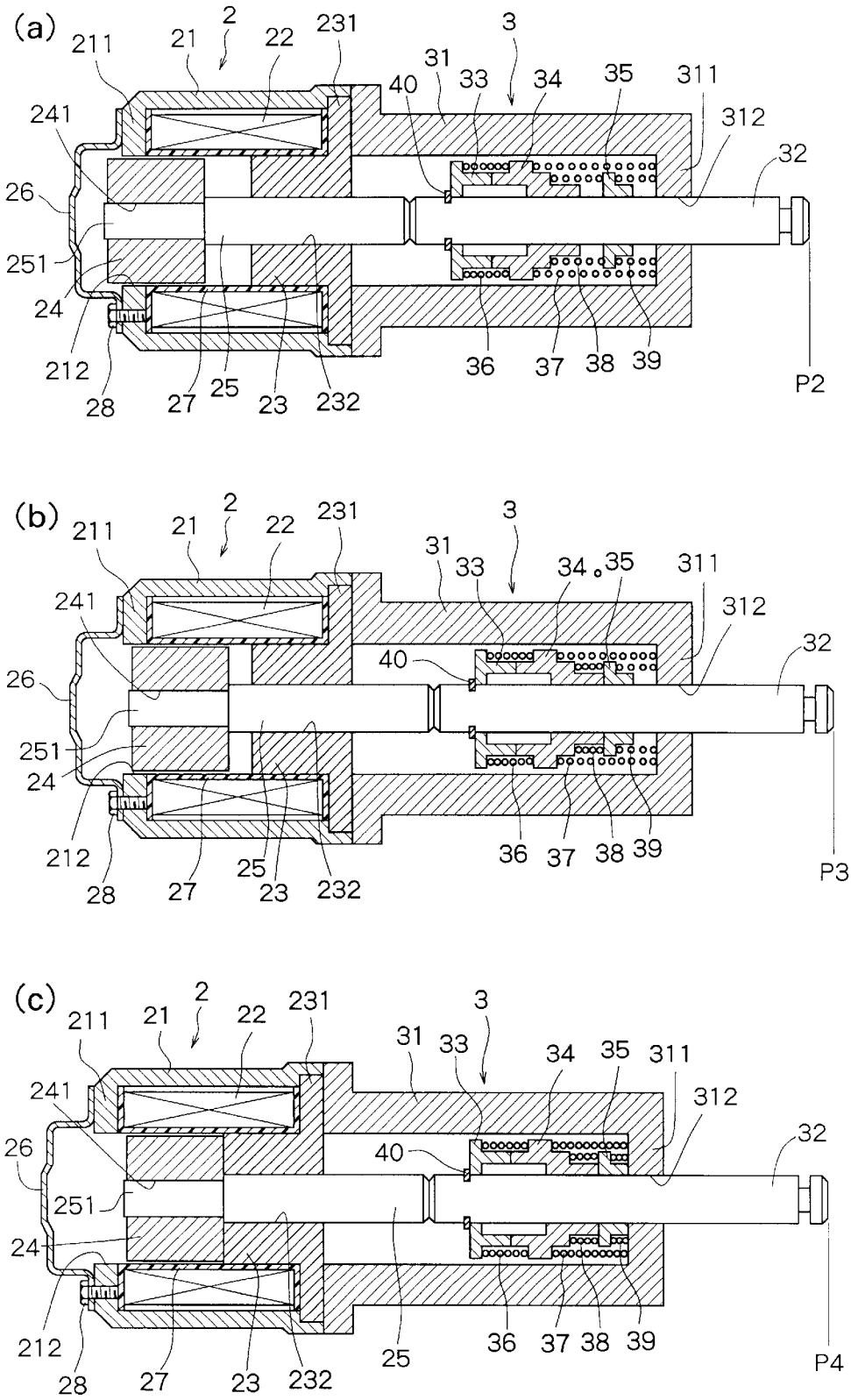
FIGS. 2(*a,b,c*) is a diagram illustrating the operation of the electromagnetic solenoid actuator shown in FIG. 1.

When a voltage of, for example, 2 V is applied to the electromagnetic coil 22 that constitutes the electromagnetic solenoid 2 in the state shown in FIG. 1, the moving iron core 24 is attracted by the fixed iron core 23, whereby the moving iron core 24 and the operation rod 25 produce a thrust toward the right in the drawing. As a result, the moving iron core 24, operation rod 25, interlocking rod 32 and first moving ring 33 move toward the right, as shown in FIG. 2(*a*), overcoming the spring force of the first compression coil spring 36. Here, the second moving ring 34 is not displaced since the spring force of the second compression coil spring 37 is set to be greater than the spring force of the first compression coil spring 36. The moving iron core 24, operation rod 25, interlocking rod 32 and first moving ring 33 come to a halt at a position where the first moving ring 33 is in contact with the second moving ring 34. Accordingly, the moving iron core 24, operation rod 25 and interlocking rod 32 are brought to a second operation position (P2) shown in FIG. 2(*a*).

Next, when a voltage of, for example, 4 V is applied to the electromagnetic coil 22 that constitutes the electromagnetic solenoid 2, the moving iron core 24 and the operation rod 25 produce an increased thrust toward the right. As a result, as shown in FIG. 2(*b*), the moving iron core 24, operation rod 25 and interlocking rod 32 move toward the right overcoming the spring force of the second compression coil spring 37 in a state where the first moving ring 33 is in contact with the second moving ring 34. Then, the moving iron core 24, operation rod 25 and interlocking rod 32 come to a halt at a position where the second moving ring 34 is in contact with the third moving ring 35. Accordingly, the moving iron core 24, operation rod 25 and interlocking rod 32 are brought to a third operation position (P3) shown in FIG. 2(*b*).

Next, when a voltage of, for example, 8 V is applied to the electromagnetic coil 22 that constitutes the electromagnetic solenoid 2, the moving iron core 24 and the operation rod 25 produce a further increased thrust toward the right. As a result, as shown in FIG. 2(*c*), the moving iron core 24, operation rod 25 and interlocking rod 32 move toward the right overcoming the spring forces of the second compression coil spring 37 and the fourth compression coil spring 39 in a state where the second moving ring 34 is in contact with the third moving ring 35. Then, the moving iron core 24, operation rod 25 and interlocking rod 32 come to a halt at a position where the third moving ring 35 is in contact with the end wall 311 of the casing 31. Accordingly, the moving iron core 24, operation rod 25 and interlocking rod 32 are brought to a fourth operation position (P4) shown in FIG. 2(*c*).

As described above, the electromagnetic solenoid actuator according to the illustrated embodiment comprises: an electromagnetic solenoid 2 constituted by an electromagnetic coil 22, a fixed iron core 23, a moving iron core 24 and an operation rod 25; and a position-limiting mechanism 3 for limiting the operation rod 25 to a plurality of operation positions depending upon a thrust produced by the operation rod 25 in compliance with the amount of electric power fed to the electromagnetic coil 22. Accordingly, the electromagnetic solenoid actuator of the embodiment can be constituted in a compact size and at a low cost.

The electromagnetic solenoid actuator of the present invention constituted as described above exhibits action effect as described below.

That is, according to the present invention, an electromagnetic solenoid actuator which allows the operation rod to be brought to a plurality of operation positions can be constituted inexpensively and in a compact size since it has a position-limiting mechanism for limiting the operation rod to a plurality of operation positions according to a thrust produced by the operation rod which constitutes the electromagnetic solenoid in compliance with the amount of electric power fed to the electromagnetic coil which constitutes the electromagnetic solenoid.

What I claim is:

1. An electromagnetic solenoid actuator comprising a cylindrical casing, an electromagnetic coil arranged in said casing, a fixed iron core arranged in said electromagnetic coil, a moving iron core arranged to come in contact with, and separate away from, said fixed iron core, and an operation rod mounted in said moving iron core, wherein provision is made of a position-limiting mechanism for limiting said operation rod to a plurality of operation positions according to a thrust produced by said operation rod in compliance with the amount of electric power fed to said electromagnetic coil.

2. An electromagnetic solenoid actuator according to claim 1, wherein said position-limiting mechanism comprises at least one moving ring arranged on said operation rod or on an interlocking rod operated by said operation rod so as to slide, a first spring member arranged between said moving ring and said operation rod or said interlocking rod, and a second spring member arranged between said moving ring and said casing.

3. An electromagnetic solenoid actuator according to claim 1, wherein said position-limiting mechanism comprises a first ring arranged on said operation rod or on an interlocking rod operated by said operation rod and is limited from moving toward the side of said moving iron core, a second ring and a third ring arranged on said operation rod or on said interlocking rod so as to slide on the side of said first ring opposite to said moving iron core, a first compression coil spring arranged between said first ring and said second ring, a second compression coil spring arranged between said second ring and said casing, a third compression coil spring arranged between said second ring and said third ring, and a fourth compression coil spring arranged between said third ring and said casing, the spring force of said second compression coil spring being greater than the spring force of said first compression coil spring, and the spring force of said fourth compression coil spring being greater than the spring force of said third compression coil spring.

* * * * *